US011286875B1

(12) United States Patent
Reding et al.

(10) Patent No.: US 11,286,875 B1
(45) Date of Patent: Mar. 29, 2022

(54) INTER-CYLINDER BORE COOLANT PASSAGE FOR ENHANCED CAVITATION PROTECTION IN AN ENGINE BLOCK

(71) Applicant: Deere & Company, Moline, IL (US)

(72) Inventors: Robert J. Reding, Cedar Falls, IA (US); Terry W. Schwickerath, Parkersburg, IA (US); Donald E. Schmitz, Cedar Falls, IA (US); Balkrishna N. Bejgamwar, Pune (IN); Alexander D. Huibregtse, Waterloo, IA (US)

(73) Assignee: DEERE & COMPANY, Moline, IL (US)

( * ) Notice: Subject to any disclaimer, the term of this patent is extended or adjusted under 35 U.S.C. 154(b) by 0 days.

(21) Appl. No.: 17/181,564

(22) Filed: Feb. 22, 2021

(51) Int. Cl.
*F02F 1/12* (2006.01)
*F02F 1/40* (2006.01)

(52) U.S. Cl.
CPC . *F02F 1/12* (2013.01); *F02F 1/40* (2013.01)

(58) Field of Classification Search
CPC ..... F02F 1/12; F02F 1/40; F02F 1/004; F02F 1/10; F02F 1/16; F02F 1/163; F02F 1/166; F01P 3/02; F01P 7/14; F01P 11/14; F01P 2003/021
See application file for complete search history.

(56) References Cited

U.S. PATENT DOCUMENTS 6,675,750 B1 1/2004 Wagner
9,127,617 B2 * 9/2015 McGiffen ..... F02F 1/16
9,593,639 B2 * 3/2017 Batta ..... F02F 1/14

OTHER PUBLICATIONS

Deere & Company, Utility U.S. Appl. No. 16/556,936, filed Aug. 30, 2019. (40 pages).

* cited by examiner

*Primary Examiner* — Grant Moubry
(74) *Attorney, Agent, or Firm* — Klintworth & Rozenblat IP LLP

(57) ABSTRACT

An engine block assembly utilized within a liquid-cooled engine includes an anti-cavitation engine block having a first cylinder, a second cylinder, and an inter-cylinder wall section located between the first and second cylinders. An anti-cavitation passage is formed through the inter-cylinder wall section that extends between the first cylinder and the second cylinder. A cylinder liner is inserted into the first cylinder and has an outer circumferential surface toward which the anti-cavitation passage opens. A water jacket extends at least partially around the outer circumferential surface of the cylinder liner. The anti-cavitation passage is formed through the inter-cylinder wall section at a location adjacent a region of thrust displacement of the cylinder liner and enables a flow of liquid coolant in the water jacket therethrough to deter cavitation within the water jacket adjacent the region of thrust displacement of the cylinder liner during operation of the liquid-cooled engine.

20 Claims, 8 Drawing Sheets

INTER-CYLINDER BORE COOLANT PASSAGE FOR ENHANCED CAVITATION PROTECTION IN AN ENGINE BLOCK

CROSS-REFERENCE TO RELATED APPLICATION(S)

Not applicable.

STATEMENT OF FEDERALLY SPONSORED RESEARCH OR DEVELOPMENT

Not applicable.

FIELD OF THE DISCLOSURE

This disclosure relates to engine blocks having anti-cavitation passages (herein, "anti-cavitation engine blocks") and to engine block assemblies containing anti-cavitation engine blocks.

BACKGROUND OF THE DISCLOSURE

Water jackets are commonly utilized for thermal regulation in liquid-cooled internal combustion engines, including diesel engines onboard tractors and other work vehicles. About their inner peripheries, the water jackets are bound by cylinder sleeves or liners inserted into one or more banks of cylinders provided in the engine block body. About their outer peripheries, the water jackets are bound by the inner walls of the engine block, which define the cylinders. During operation of the liquid-cooled engine, a pump circulates a liquid coolant (typically water admixed with antifreeze, corrosion inhibitors, or other additives) through the water jackets. The liquid coolant may be drawn from upper regions of the water jackets, directed through a radiator (or other heat exchanger) to transfer heat from the coolant to the ambient environment, filtered, and then reinjected into lower regions of the water jackets in a reduced temperature state. By actively circulating a liquid coolant through the water jackets in this manner, excess heat is removed from the cylinder liners, the cylinder heads, and other regions of the engine to prolong engine component lifespan and boost overall engine performance.

SUMMARY OF THE DISCLOSURE

Engine block assemblies including anti-cavitation engine blocks and utilized within liquid-cooled engines are disclosed. In embodiments, the anti-cavitation engine block contains a first cylinder having a first cylinder centerline, a second cylinder having a second cylinder centerline, and an inter-cylinder wall section. The inter-cylinder wall section is located between the first cylinder and the second cylinder, as taken along a longitudinal axis perpendicular to the first and second cylinder centerlines. An anti-cavitation passage is formed through the inter-cylinder wall section that extends between the first cylinder and the second cylinder, while a cylinder liner is inserted into the first cylinder. The cylinder liner has an outer circumferential surface toward which the anti-cavitation passage opens. A water jacket extends at least partially around the outer circumferential surface of the cylinder liner. The anti-cavitation passage is formed through the inter-cylinder wall section at a location adjacent a region of thrust displacement of the cylinder liner, as taken axially along the first cylinder centerline, and enables a flow of liquid coolant in the water jacket therethrough to deter cavitation within the water jacket adjacent the region of thrust displacement of the cylinder liner during operation of the liquid-cooled engine.

In further embodiments, the engine block assembly includes an anti-cavitation engine block having a plurality of cylinders formed therein and spaced along a longitudinal axis perpendicular to centerlines of the cylinders. The anti-cavitation engine block further includes inner block walls that bound outer peripheries of the cylinders, with the inner block walls including inter-cylinder wall sections interspersed with the plurality of cylinders along the longitudinal axis. Cylinder liners are inserted into the plurality of cylinders, and an anti-cavitation passage is formed through each inter-cylinder wall section, between each adjacent pair of cylinders of the plurality of cylinders, in an upper half of the inter-cylinder wall section.

The details of one or more embodiments are set-forth in the accompanying drawings and the description below. Other features and advantages will become apparent from the description, the drawings, and the claims.

BRIEF DESCRIPTION OF THE DRAWINGS

At least one example of the present disclosure will hereinafter be described in conjunction with the following figures.

Figure 1:
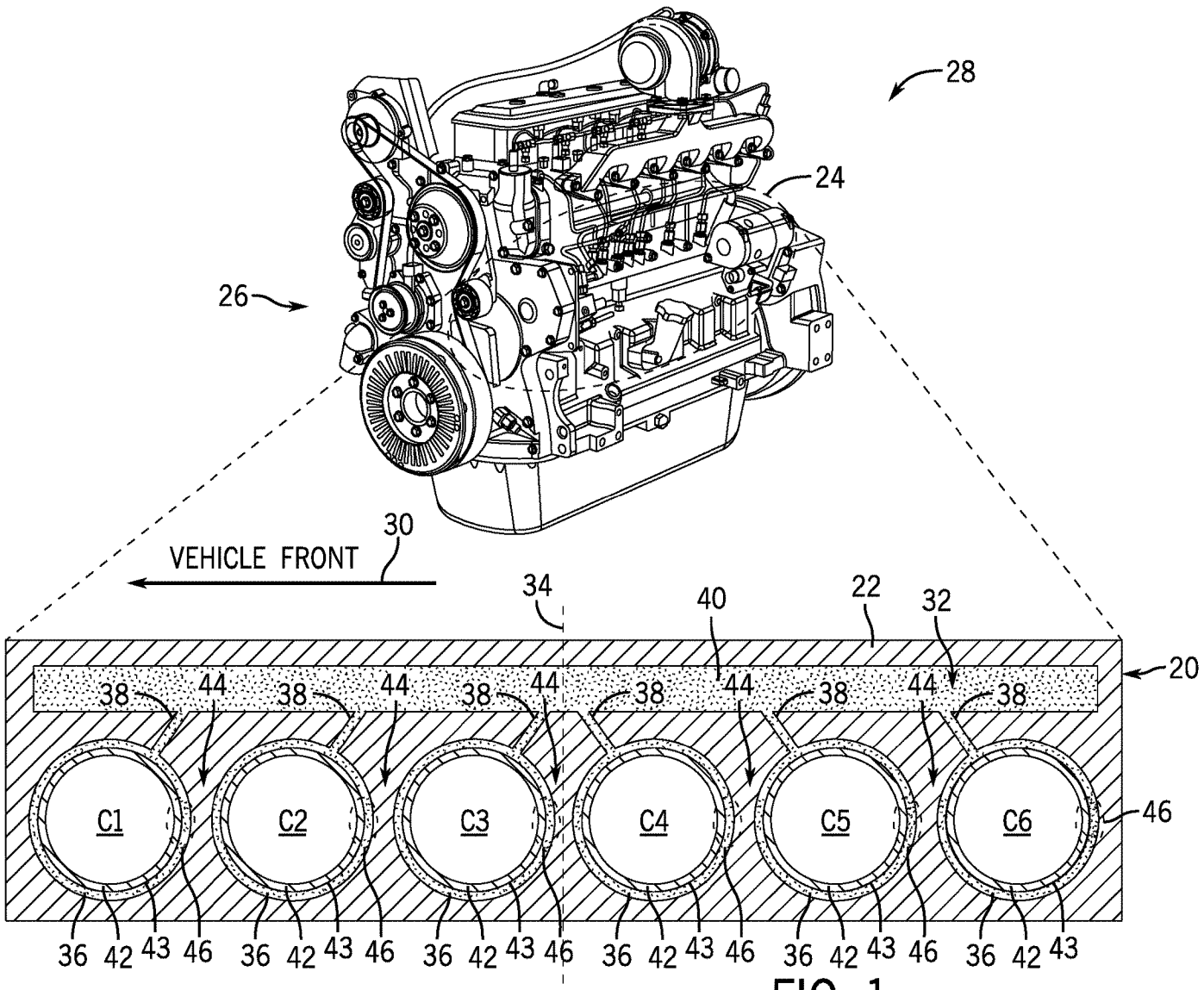
FIG. 1 depicts an example liquid-cooled engine (shown in perspective) including an engine block assembly (shown as a cross-sectional schematic), with dashed circles identifying regions of the engine block in which anti-cavitation passages are usefully formed in certain embodiments of the present disclosure.

Like reference symbols in the various drawings indicate like elements. For simplicity and clarity of illustration, descriptions and details of well-known features and techniques may be omitted to avoid unnecessarily obscuring the example and non-limiting embodiments of the invention described in the subsequent Detailed Description. It should further be understood that features or elements appearing in the accompanying figures are not necessarily drawn to scale unless otherwise stated.

DETAILED DESCRIPTION

Embodiments of the present disclosure are shown in the accompanying figures of the drawings described briefly above. Various modifications to the example embodiments may be contemplated by one of skill in the art without departing from the scope of the present invention, as set-forth in the appended claims. As appearing herein, the term "anti-cavitation engine block" refers to an engine block in which one or more anti-cavitation passages are formed, as described below. Similarly, the term "engine block assembly" refers to an anti-cavitation engine block assembled or combined with one or more additional components, such as cylinder liners bounding the outer peripheries of water jackets encasing the engine block cylinders.

Overview

As previously noted, liquid-cooled internal combustion engines commonly contain water jacket-based cooling systems; that is, cooling systems including water jackets encasing the cylinder liners and through which a liquid coolant is circulated to remove excess heat from the cylinder liners, the cylinder headers, and other components during engine operation. In certain instances, cavitation can occur within the water jackets as highly elevated temperatures and low vapor pressures develop within certain localized regions of the water jackets. In the event of cavitation, the highly concentrated forces resulting from the inward collapse of low-pressure bubbles can physically dislodge bits of material from the outer surfaces of the liners; and, depending upon the severity of cavitation, potentially cause relatively deep pitting or other structural compromise of the cylinder liners. Water jacket cavitation is a somewhat complex phenomenon due to the various factors influencing the occurrence of cavitation. Such factors may include, but are not limited to, the operating characteristics of the engine (e.g., combustion temperatures), coolant flow characteristics through the water jackets, the degree of cylinder liner displacement (particularly at maximum thrust displacement), and critical engine dimensions, such as cylinder-to-cylinder spacing, liner wall thickness, and local water jacket thicknesses (as measured radially from the cylinder centerlines).

With particular regard to the impact of cylinder liner displacement on water jacket cavitation, it is recognized that cylinder liner displacement is caused by radial forces imposed on the cylinder liner by the piston as it reciprocates therein. That is, because the connecting rod driving the piston is at an angle when the piston is between the top dead center and bottom dead center positions, any forces imposed on the connecting rod $F_{rod}$ (and therefore imposed on the piston) have both an axial (or "y") component and a radial (or "x") component. The axial force on the connecting rod is equal and opposite to a firing force $F_{firing}$ imposed on the rod when combustion drives the piston downward, while the radial thrust force $F_{thrust}$ results from (and is dependent on) the angle of connecting rod as the piston travels downward through the cylinder liner. The radial thrust force $F_{thrust}$ causes the cylinder liner to bend in an outward motion as force is applied thereto by the piston and then flex back after the force from the piston is removed (as the piston moves down in the cylinder liner). This inward/outward motion of the cylinder liner is translated to the coolant around the cylinder liner, thereby causing the coolant particles to move away from the cylinder liner and forming a low-pressure area in the water jacket in which cavitation can occur. Thus, displacement of the cylinder liner can occur in a region where the radial thrust force $F_{thrust}$ is high, with it understood that the radial thrust force $F_{thrust}$ is high when the firing force $F_{firing}$ applied to the piston is also high and when a crank angle is present on the connecting rod.

To reduce the likelihood of water jacket cavitation and cylinder liner damage, engine block assemblies including anti-cavitation engine blocks are provided; that is, engine blocks having "anti-cavitation passages" formed in selected or targeted regions thereof. The anti-cavitation passages are formed in the inner block walls of the engine block, which peripherally bound the cylinders and the water jackets formed between the inner block walls and the cylinders liners (when inserted into their corresponding cylinders). Specifically, the anti-cavitation passages are formed in inter-cylinder wall sections that extend between and partition adjacent cylinders, with the anti-cavitation passages extending through the inter-cylinder wall sections to create a fluid path between adjacent cylinders.

The anti-cavitation passages are usefully formed adjacent regions of the cylinder liners identified as particularly susceptible to cavitation damage, which as indicated above, may correspond to areas where the local water jacket thickness is reduced and where the degree of cylinder liner displacement is high, i.e., at a region of maximum thrust displacement of the cylinder liner. The positioning of anti-cavitation passages in such regions serves to reduce, if not prevent, cavitation-induced damage to the cylinder liners during operation of a liquid-cooled engine by improving coolant circulation in the water jacket in these regions. The flow of liquid coolant into the anti-cavitation passage enhances the backfill of liquid coolant into low-pressure zones or coolant voids that may form adjacent displaced regions of the cylinder liners, i.e., adjacent the outer circumferential surface of the cylinder liner at the location of maximum thrust displacement, such that the formation of low-pressure zones in the water jacket at these regions is prevented and cavitation within the water jacket is deterred.

The below-described anti-cavitation engine blocks can beneficially be fabricated by casting. The anti-cavitation passages may be defined, in whole or in part, when initially casting the engine block, to enable the integration of the anti-cavitation passages into engine block designs with relatively little modification and minimal additional cost. These advantages notwithstanding, other manufacturing techniques for fabricating the anti-cavitation passages and, more generally, the anti-cavitation engine block are also possible in further implementations.

An example embodiment of an engine block assembly including an anti-cavitation engine block will now be described in conjunction with FIGS. 1-6. By way of non-limiting example, the following describes the anti-cavitation engine block in the context of a particular type of liquid-cooled engine, namely, a diesel engine having an in-line, six-cylinder configuration and suitable for usage onboard a tractor or other work vehicle. The following example notwithstanding, the anti-cavitation engine block can be incorporated into various types of liquid-cooled internal combustion engines benefiting from enhanced protection against water jacket cavitation, including engine blocks having flat and V-piston configurations.

Example Embodiment of an Engine Block Assembly Including an Anti-Cavitation Engine Block With initial reference to FIG. 1, an engine block assembly 20 including an anti-cavitation engine block 22 is illustrated in accordance with an example embodiment of the present disclosure. As shown in the upper half of FIG. 1, the engine block assembly 20 may be generally located within a circled region 24 of a liquid-cooled internal combustion engine 26, which is included within a larger vehicle powertrain 28 (partially shown). Here, the liquid-cooled internal combustion engine 26 (hereafter, "the liquid-cooled engine 26") contains six cylinders arranged in an inline (single row or bank) configuration. For ease of reference, the cylinders contained within the liquid-cooled engine 26 are successively numbered as "C1" through "C6." The C1 cylinder is contained within the forwardmost or leading end portion of the anti-cavitation engine block 22; that is, the portion of the engine block 22 located closest the vehicle front, as indicated by arrow 30. The C2 through C6 cylinders are numbered in succession following the C1 cylinder in an aftward direction, with the C6 cylinder contained within the trailing end portion of the engine block 22.

A water jacket cooling system 32 is integrated into the liquid-cooled engine 26. The water jacket cooling system 32 includes a plurality of water jackets 36, as well as various plumbing features formed in the anti-cavitation engine block 22. The plumbing features may include, for example, a number of coolant flow passages 38 branching from a coolant manifold 40 formed in a side portion of the engine block 22. Although not shown individually for clarity, the water jacket cooling system 32 further includes various other components for providing the desired coolant circulation function, including a pump, a radiator (or other heat exchanger), and additional fluid connections. The water jackets 36 each extend at least partially around, and may fully circumscribe, the C1 through C6 cylinders. In the illustrated example, the water jackets 36, the coolant manifold 40, and the coolant flow passages 38 are generally bilaterally symmetrical about a vertical plane 34 extending between the C3 and C4 cylinders (orthogonal to the plane of the page in the lower portion of FIG. 1). In further implementations, the engine block assembly 20 may assume another form, while the water jacket cooling system 32 may include various other components suitable for circulating a liquid cooling through any practical number of water jackets within the anti-cavitation engine block 22.

Cylinder sleeves or liners 42 are inserted into each of the C1 through C6 cylinders. When viewed in three dimensions, the cylinder liners 42 assume the form of generally annular or tubular bodies, which are sized for a close tolerance fit or mating reception within the C1 through C6 cylinders. The outer diameters of the cylinders liners 42 are dimensioned to provide an annular clearance or gap between midsections of the cylinder liners 42 and the inner block walls 43, which bound the outer peripheries of the C1 through C6 cylinders. This annular clearance or gap between the midsections of the cylinder liners 42 and the inner block walls 43 defines the water jackets 36, at least in substantial part. Specifically, the outer circumferential surfaces of the cylinder liners 42 bound or define the inner perimeters of the water jackets 36, while the inner block walls 43 of the engine block body 45 bound or define the outer perimeters of the water jackets 36. The portions of the inner block walls 43 extending between and partitioning adjacent cylinders are identified by reference numerals "44" in the below-described drawing figures and are referred to hereafter as "inter-cylinder wall sections 44."

As represented by dot stippling in FIG. 1, a liquid coolant (e.g., water admixed with one or more additives) is supplied to each of the water jackets 36 during operation of the liquid-cooled engine 26. The liquid coolant is drawn from the coolant manifold 40 and directed through the coolant flow passages 38, each of which connects the coolant manifold 40 to a different one of the water jackets 36. In certain instances, and as previously noted, cavitation may occur within certain localized regions of the water jackets 36 depending upon local vapor pressures, local temperatures, and other factors occurring during operation of the liquid-cooled engine 26. Absent provision of the anti-cavitation passages described below, such cavitation may be sufficiently severe to impart an undesirable degree of structural damage to the cylinder liners 42 by, for example, inducing pitting or other material loss along the outer circumferential walls of the cylinder liners 42 exposed to the cavitation. Further description of the location and severity of cavitation damage to an example cylinder liner contained in a tested engine block lacking anti-cavitation passages is set-forth below in the section entitled "TESTING RESULTS AND EXAMPLE REDUCTION TO PRACTICE."

As described throughout this document, the anti-cavitation passages are usefully formed adjacent regions of the cylinder liners 42 susceptible to structural damage should cavitation occur within the water jackets 36 during operation of the liquid-cooled engine 26. The locations at which cavitation is prone to occur within the water jackets 36, and therefore the regions of the cylinder liners 42 vulnerable to cavitation-caused damage, will vary among embodiments. So too will the positioning and other physical characteristics (e.g., shape and dimensions) of the anti-cavitation passages vary between different embodiments of the anti-cavitation engine block 22. However, by way of non-limiting example, undesirably high levels of cavitation may be prone to occur in some or all of the areas of the water jackets 36 called-out in FIG. 1 by dashed circles 46. Generally, these circled regions 46 correspond to the portions of the water jackets 36 adjacent the rear (aft) quadrant of the cylinder liners 42; with terms "rear" and "aft" defined relative to the intended orientation of the engine block assembly 20 when installed within a vehicle.

The circled regions 46 of the water jackets 36 may be prone to cavitation due to the relatively close cylinder-to-cylinder spacing in the illustrated example, restrictions in the flow area of the water jackets 36 in these regions (more clearly shown in subsequent drawing figures), liner thrust displacement characteristics, and other such factors. Consequentially, in embodiments, it may be beneficial to form anti-cavitation passages at locations of the inter-cylinder wall sections 44 to improve coolant flow and artificially increase the local radial thicknesses of the water jackets 36 adjacent or proximate some, if not all, the circled regions 46 denoted in FIG. 1. Stated more generally, in embodiments, the anti-cavitation passages are usefully formed in targeted regions of the inter-cylinder wall sections 44 interspersed with the C1-C6 cylinders along a longitudinal axis of the engine block 22, as described in detail below.

Referring to FIGS. 2-5 in combination with FIG. 1, the following will now describe an anti-cavitation passage formed in an example cylinder of the example anti-cavitation engine block 22. In particular, the following description principally focuses on an anti-cavitation passage 64 formed relative to the C5 cylinder. As will become apparent from the following discussion, an anti-cavitation passage 64 is formed in an inter-cylinder wall section 44 of the anti-cavitation engine block 22, which separates or partitions the C5 and C6 cylinders (identified by reference numeral "44(*a*)") taken along a longitudinal axis of the engine block 22 perpendicular to the cylinder centerlines 60. While the following description focuses principally on the C5 cylinder and the anti-cavitation passage 64 formed in the inter-cylinder wall section 44(*a*) between the C5 and C6 cylinders, similar, if not identical anti-cavitation passages 64 may be provided between other adjacent pairs of the cylinders (the C1-C4 cylinders) of the anti-cavitation engine block 22, with FIGS. 3 and 4, for example, illustrating that a second anti-cavitation passage is formed in a second inter-cylinder wall section 44 of the engine block 22, which separates or partitions the C4 and C5 cylinders (identified by reference numeral "44(*b*)" in FIG. 3). In the context of the illustrated example, then, the following description may be considered equally applicable to all the cylinders included in the anti-cavitation engine block 22, i.e., to each inter-cylinder wall section 44 between cylinders.

Figure 2:
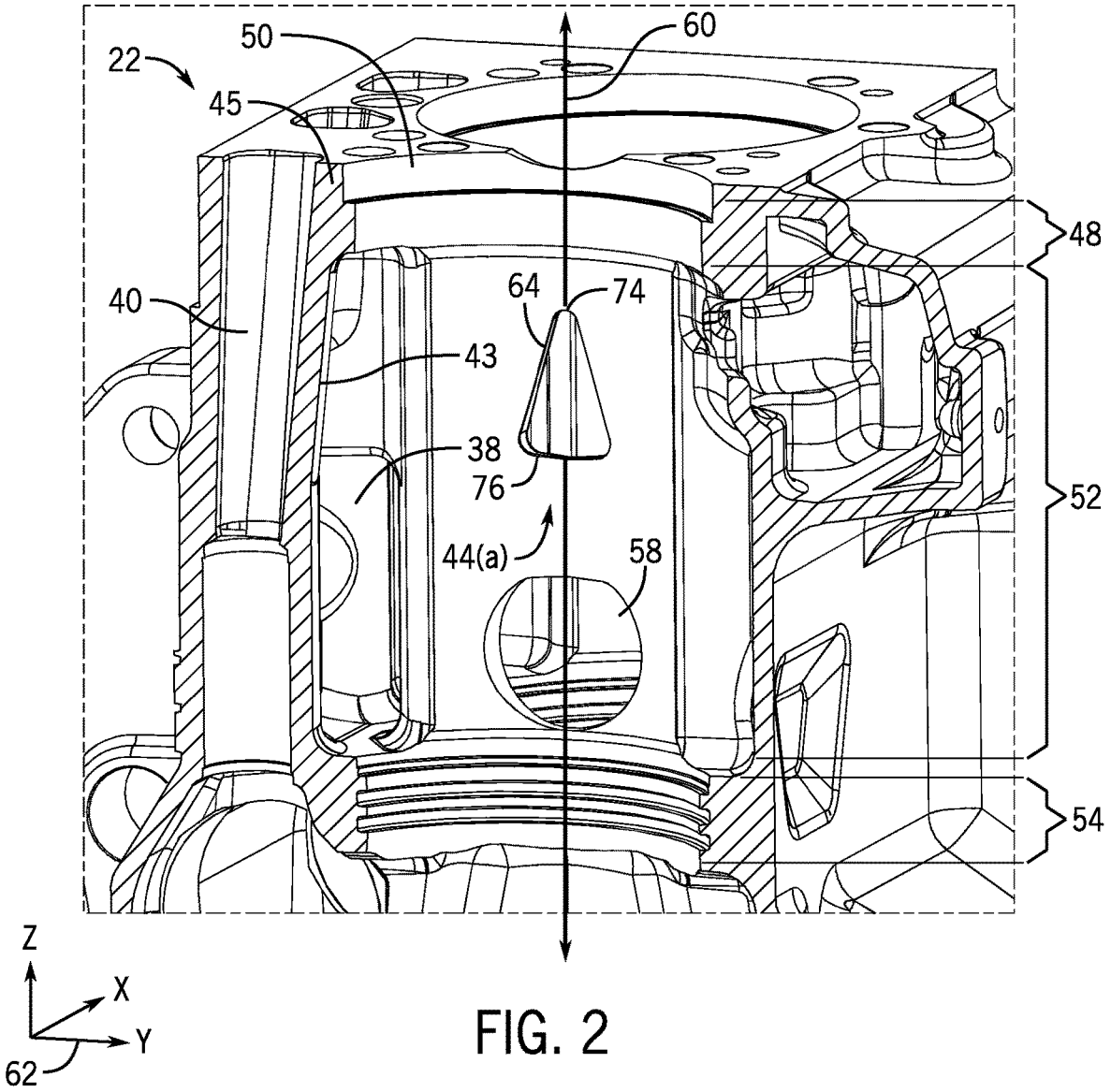
FIG. 2 is a cross-sectional view of an anti-cavitation engine block included in the example engine block assembly of FIG. 1, as taken along a section plane extending through a cylinder and parallel to the cylinder centerline, illustrating an example anti-cavitation passage formed in an inter-cylinder wall section of the engine block.
Figure 3:
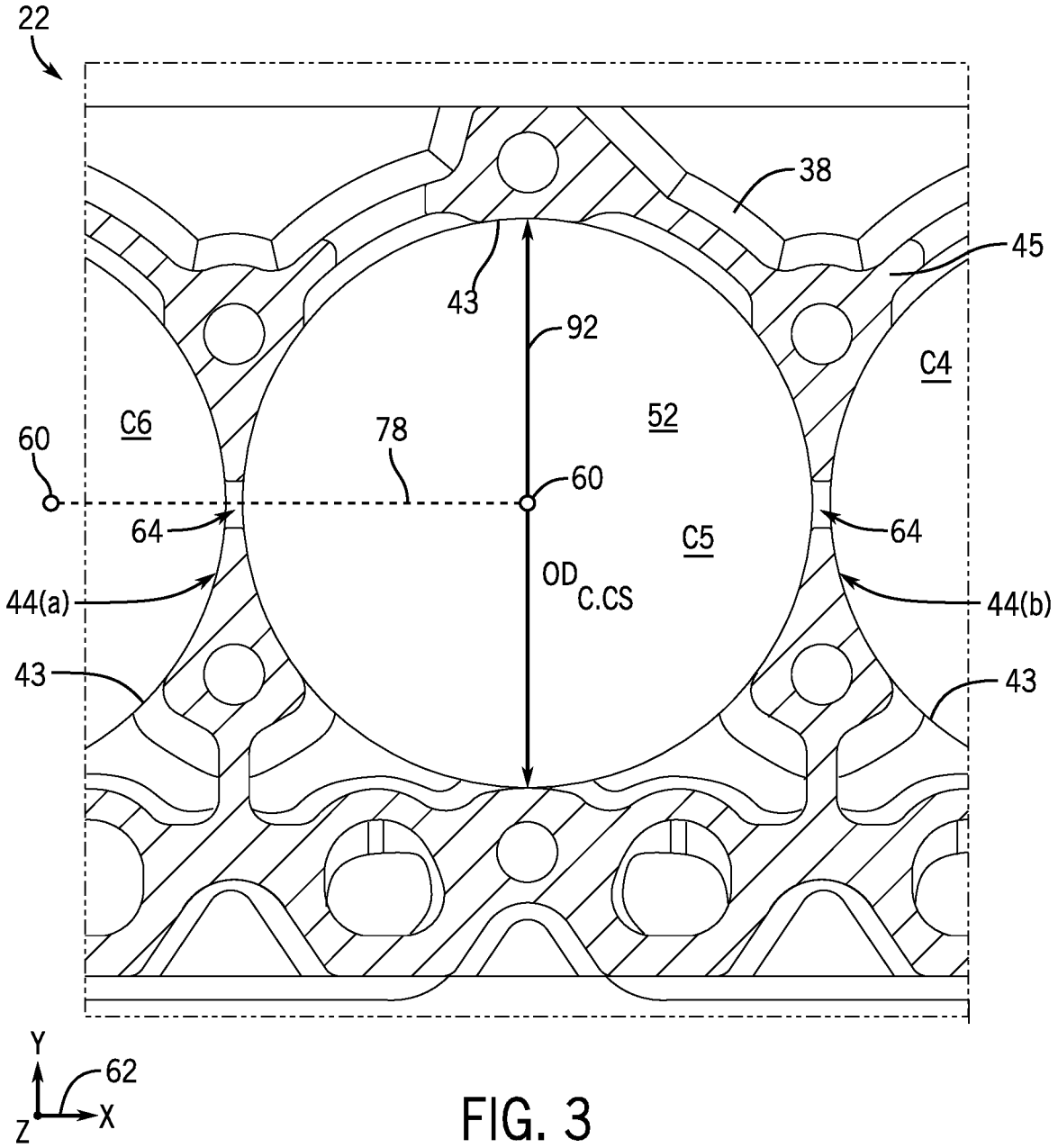
FIG. 3 is a cross-sectional view of the example anti-cavitation engine block, as taken along a section plane orthogonal to a cylinder centerline, further illustrating anti-cavitation passages formed in inter-cylinder wall sections of the engine block.

As shown in FIGS. 2 and 3, the C5 cylinder includes a combustion section 52 that corresponds to the region in which internal combustion and piston reciprocation principally occurs during operation of the liquid-cooled engine 26, as well as an upper section 48 and a lower, grooved section 54. The upper section 48 of the C5 cylinder contains a circumferential ledge or shelf 50, which matingly receives a flange provided around the upper edge of a cylinder liner 42 when inserted into the C5 cylinder (shown in FIG. 4 and described below). Below the combustion section 52, the grooved section 54 cooperates with a lower portion of the cylinder liner 42 (again, when inserted into the C5 cylinder) and sealing elements (e.g., O-rings or gaskets) to create a fluid-tight seal beneath the water jacket 36 formed within the C5 cylinder. Various other features of the anti-cavitation engine block 22 are further shown in FIGS. 2 and 3 including, for example, openings or orifices 58 fluidly connecting adjacent cylinders (e.g., C4, C5, C6) and a portion of the coolant manifold 40.

The anti-cavitation passage 64 is formed in the inter-cylinder wall section 44 of C5 cylinder to be axially positioned within the combustion section 52 of the cylinder. More specifically, the anti-cavitation passage 64 is formed at a location in a top half of the inter-cylinder wall section 44 in the combustion section 52 of the C5 cylinder, at a location that is positioned adjacent a region 66 of the cylinder liner 42 (FIG. 5) that undergoes thrust displacement, as taken axially along the centerline 60 of the C5 cylinder. This thrust displacement region 66 of the cylinder liner 42 is susceptible to structural damage from cavitation within the water jacket 36 due to bending/flexing of the cylinder liner 42 that occurs due to radial thrust forces applied thereto. Within the region of thrust displacement 66, the cylinder liner 42 may be radially displaced due to a high radial thrust force $F_{thrust}$ imposed on the cylinder liner 42 by a piston 67 (indicated in phantom in FIG. 5) during piston reciprocation, with the thrust force $F_{thrust}$ resulting from a force $F_{rod}$ present on the piston connecting rod 69 having both an axial and radial component due to an angling of the rod during engine operation. The thrust force $F_{thrust}$ may be high when a combustion firing force $F_{firing}$ applied to the piston 67 and connecting rod 69 is high, which occurs soon after combustion drives the piston downward, with it recognized that the crank angle of the connecting rod 69 also determines the amount of the thrust force $F_{thrust}$. Typically, a high amount of thrust force $F_{thrust}$ occurs around 5-20 crank angle degrees after top dead center (CADATDC), and the amount of axial displacement of the cylinder liner 42 can vary based on the firing pressure $F_{firing}$ and the thickness of the cylinder liner 42, for example.

With regard to the region of thrust displacement 66 of the cylinder liner 42, it is recognized that the location of the region 66 may vary between engines as a function of cylinder size and connecting rod length. According to an embodiment, the location of the region 66 can be broadly defined as a region/location on the cylinder liner 42 that falls within a range of 25% to 40% of the way down the cylinder liner 42 as measured from a top edge 69 of the cylinder liner, with this range determined empirically for a test engine run with hypothetical stroke and connecting rod length changes to explore a range of bore-to-stroke ratios from 0.6-1.5 and for cylinder liners 42 of varying heights (e.g., a cylinder liner with a base height and cylinder liners of +/−15%). In some embodiments, a +/−10% variation may be added to the range of 25% to 40% to account for a non-perfectly centered anti-cavitation passage 64 that corresponds to this range. Accordingly, in some implementations, the anti-cavitation passage 64 in the inter-cylinder wall section 44 may be formed such that a center thereof is 15-50% of the way down from the top edge 69 of the cylinder liner 42 or, more generally, within the top half of the inter-cylinder wall section 44, so as to align with a portion of the thrust displacement region 66 and to deter cavitation damage.

Figure 5:
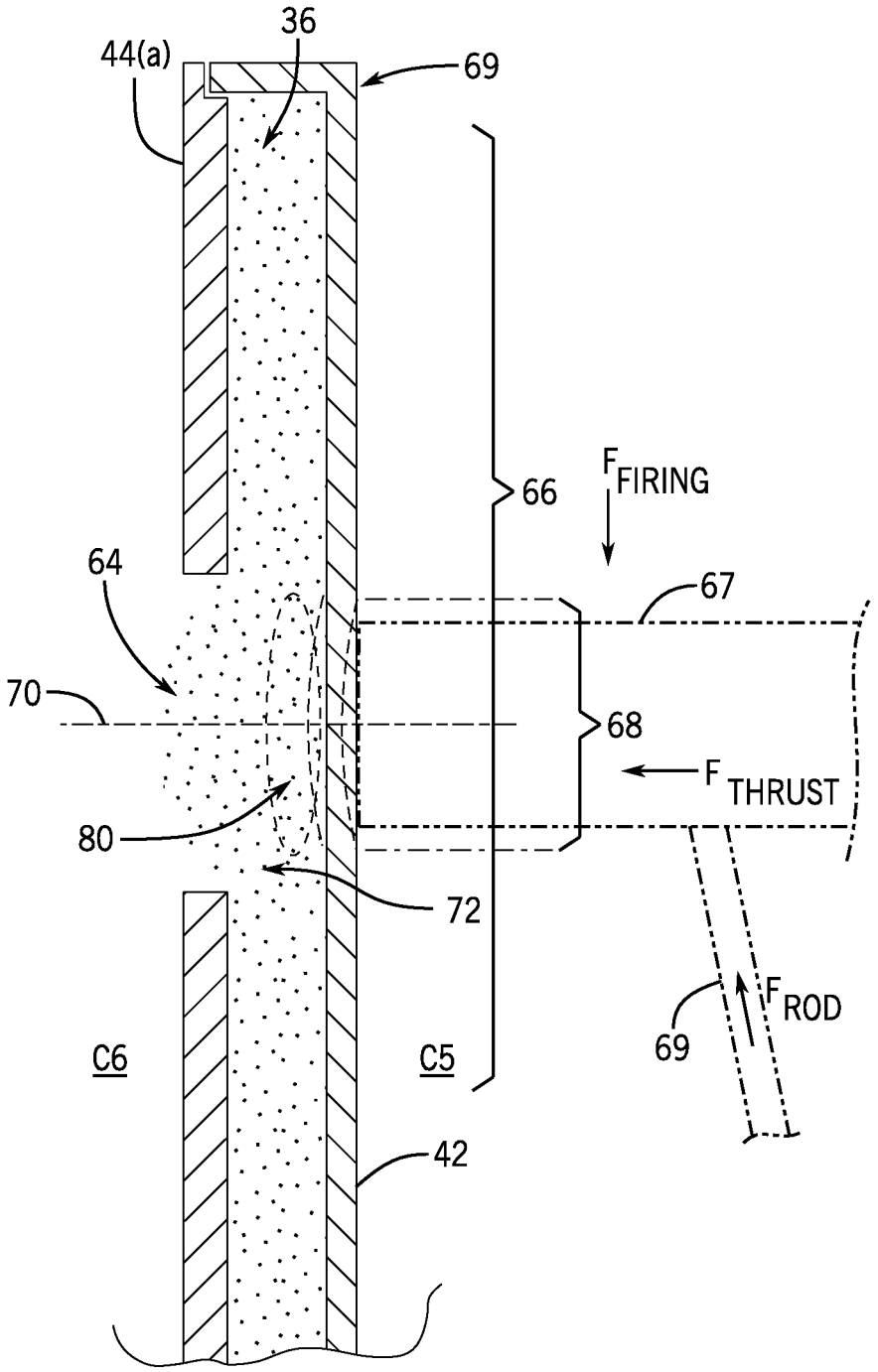
FIG. 5 is a cross-sectional view of the example anti-cavitation engine block, as taken along a section plane extending through an inter-cylinder wall section of the engine block, parallel to the cylinder centerline, further illustrating an anti-cavitation passage formed in the inter-cylinder wall section.

In the particular implementation shown in FIGS. 2 and 5, the location of the anti-cavitation passage 64 is adjacent a maximum thrust displacement region 68 where the cylinder liner 42 experiences a maximum amount of displacement, i.e., where a radial thrust force $F_{thrust}$ imposed on the cylinder liner 42 during piston reciprocation is greatest. In the illustrated embodiment, the region of the maximum thrust displacement 68 may encompass a range of 70 to 90 mm downward from the top edge 69 of the cylinder liner 42. As can be seen in FIG. 2, the anti-cavitation passage 64 is located above opening 58, with it recognized that opening 58 fluidly connects adjacent cylinders and a portion of the coolant manifold 40 but is not in a region in which cavitation damage is prone to occur (i.e., not in the region of thrust displacement 66 of the cylinder liner 42).

As shown in FIG. 5, within the region of maximum thrust displacement 68, a specific axial location 70 of maximum thrust displacement of the cylinder liner 42 can be identified where $F_{thrust}$ is greatest, with $F_{thrust}$ tapering off above and below this axial location in the maximum thrust displacement region 68, such as at 75 mm downward from the top edge 69 of the cylinder liner 42. According to an embodiment, the anti-cavitation passage 64 is positioned such that it is aligned with the axial location 70 of the maximum thrust displacement and may be further positioned such that the passage 64 (i.e., the opening 72 thereof) has approximately equal areas (+/−10%) above and below the location 70 of maximum thrust displacement. This alignment of the anti-cavitation passage 64 relative to the location 70 of maximum thrust displacement provides for an improvement in back-filling or backflow of the liquid coolant into a low-pressure zone that is formed adjacent the outer circumferential surface of the cylinder liner 42 at the location 70 of maximum thrust displacement of the cylinder liner 42 during operation of the liquid-cooled engine, as will be explained in greater detail further below.

The shape and dimensions of the anti-cavitation passage 64 may vary among embodiments, with it recognized that the shape and dimensions are determined based on considerations of enabling a sufficient flow of coolant though the passage 64 (to prevent cavitation in the water jacket 36 in the region of max thrust displacement 68) and maintaining structural integrity of the inter-cylinder wall section 44. At a low or bottom end limit, the dimensions of the anti-cavitation passage 64 should be larger than a potential cavitation zone 80 formed adjacent the region of maximum thrust displacement 68 of the cylinder liner 42. Thus, for example, for an expected cavitation zone 80 having dimensions of 20 mm in axial height and 7 mm in width, the opening 72 of the anti-cavitation passage 64 would have minimum dimensions of 20 mm in axial height and 7 mm in width, for a minimum opening area of at least 140 $mm^2$. Ideally, the dimensions and area of the anti-cavitation passage 64 would be much larger than the area of the cavitation zone 80, with a high or top end limit on the dimensions only constrained by structural considerations of the inter-cylinder wall section 44. That is, if the anti-cavitation passage 64 is too large, the inter-cylinder wall section 44 may not be structurally sound enough to withstand forces applied thereto during operation of the liquid-cooled engine.

According to embodiments, the anti-cavitation passage 64 may be formed to have any of a number shapes, with non-limiting examples including circular, oval, rectangular, or triangular. If sufficiently sized (and positioned adjacent the region of the cylinder liner 42 being particularly susceptible to cavitation damage, i.e., adjacent the maximum thrust displacement region 68 of the cylinder liner 42), the anti-cavitation passage 64 will deter cavitation to a significant extent. However, it is recognized that the shape of the anti-cavitation passage 64 can impact the structural integrity of the inter-cylinder wall section 44. According to an example embodiment, and as illustrated in FIG. 2, the anti-cavitation passage 64 comprises a generally triangular shaped passage that widens from a top point 74 to a bottom base 76. The triangular shaped anti-cavitation passage 64 has been found to maintain structural integrity of the inter-cylinder wall section 44 to a greater extent that other opening shapes of similar size.

Figure 6:
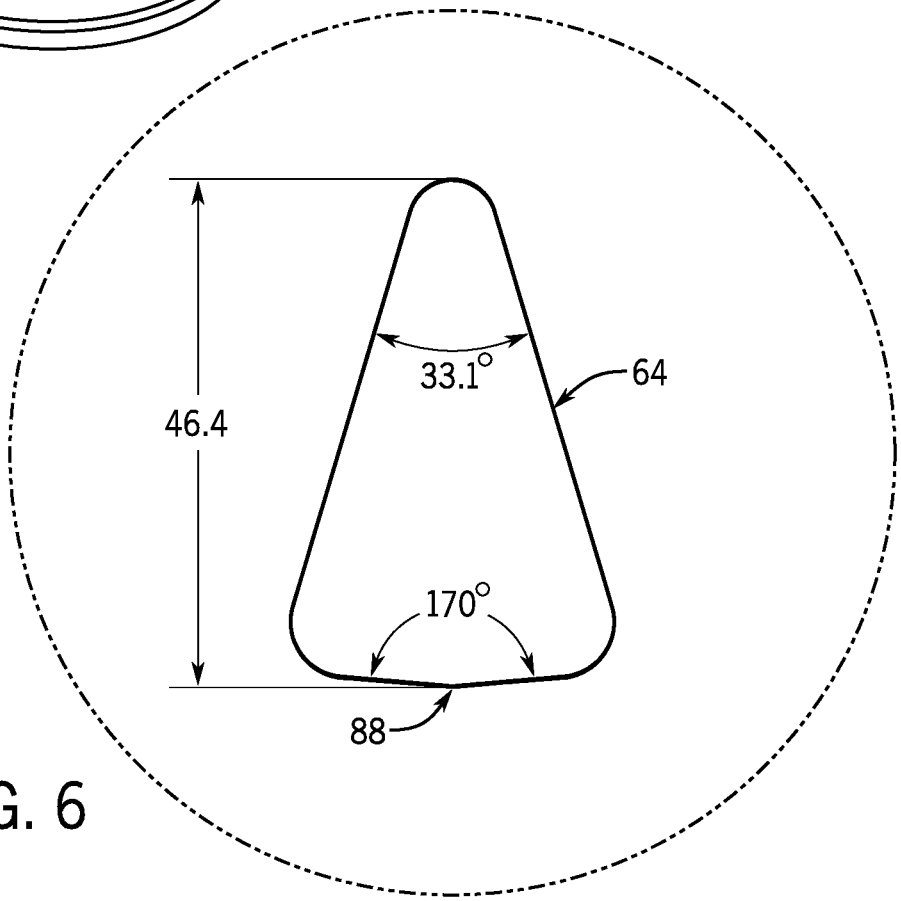
FIG. 6 a detailed image of an anti-cavitation passage formed into the anti-cavitation engine block of FIGS. 2-5.

Referring to FIG. 6, a detailed image of an example anti-cavitation passage 64 is provided. The passage 64 has a generally triangular shape, with a height of 46.4 mm, a top angle of 33.1 degrees, and a non-linear base angled out from a bottom center point 88 at 170 degrees. The anti-cavitation passage 64 is thus configured to be sized larger than a potential cavitation zone that would form adjacent a region of maximum thrust displacement of the cylinder liner, thereby greatly reducing the potential for cavitation damage of the cylinder lining occurring.

Referring again now to FIG. 3, a connecting line 78 can be drawn between the cylinder centerlines 60 of the C5 and C6 cylinders. The connecting line 78 may be coaxial with a longitudinal axis of the engine block 22, which intersects and extends perpendicular to the cylinder centerlines 60. According to an embodiment, the anti-cavitation passage 64 is formed in the inter-cylinder wall section 44(*a*) so as to be centered on the connecting line 78. Furthermore, in addition to anti-cavitation passage 64 being formed in the inter-cylinder wall section 44(*a*) between the C5 and C6 cylinders, anti-cavitation passages 64 are also formed in the inter-cylinder wall sections 44 separating other pairs of cylinders in the engine block, such as the inter-cylinder wall section 44(*b*) between the C4 and C5 cylinders shown in FIG. 3. The foregoing description pertaining to the anti-cavitation passage 64 in inter-cylinder wall section 44(*a*) may likewise apply to the anti-cavitation passage 64 formed in the inter-cylinder wall section 44(*b*) between the C4 and C5 cylinders, as well as other anti-cavitation passages 64 formed in the engine block 22. As shown in FIG. 3, the anti-cavitation passage 64 formed in the inter-cylinder wall section 44(*a*) is aligned with the anti-cavitation passage 64 formed in the inter-cylinder wall section 44(*b*) as taken along the longitudinal axis of the engine block 22 (corresponding to the X-axis of coordinate legend 62).

Figure 4:
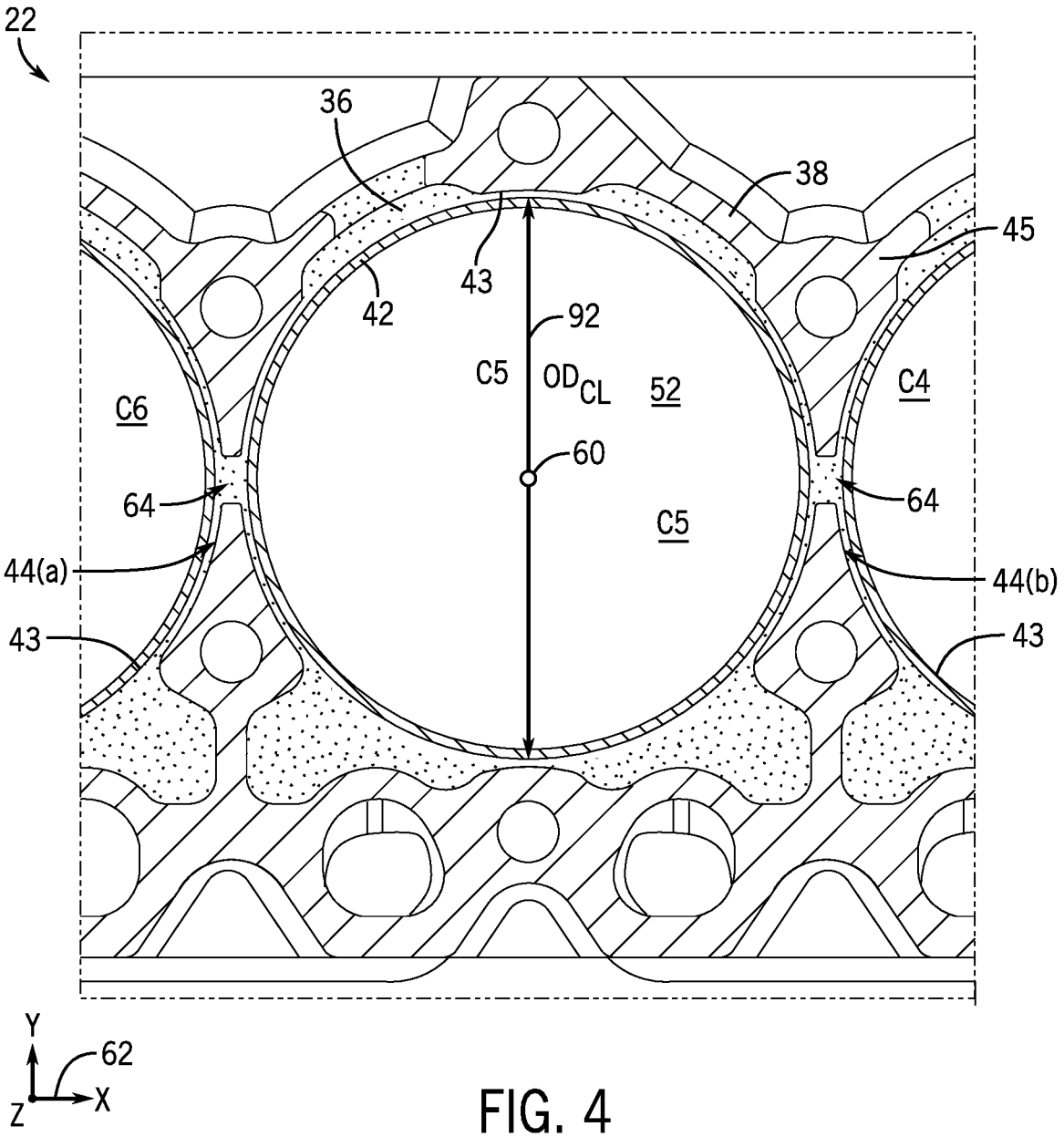
FIG. 4 is a cross-sectional view of the example engine block assembly (corresponding to the cross-section shown in FIG. 3) illustrating the anti-cavitation passages fluidly connecting the water jackets of adjacent cylinders to deter cavitation within the water jacket during operation of a liquid-cooled engine.

Addressing now FIGS. 4 and 5, in combination with FIGS. 2 and 3, the anti-cavitation engine block 22 and, more generally, the engine block assembly 20 is shown in cross-section after insertion of a cylinder liner 42 into the C5 cylinder and filling of the now-defined water jackets 36 with a liquid coolant (again, represented by dot stippling). The minimum outer diameter of the cylinder liner 42 inserted into the cylinder C5 is identified as "$OD_{CL}$" by a double-headed arrow 90 in FIG. 4. The outer diameter of the cylinder liner 42 ($OD_{CL}$) is slightly less than the diameter of the combustion section 52 of the cylinder C5, which is identified as "$OD_{C.CS}$" by a double-headed arrow 92 in FIG. 3 (further described below). In this manner, and as previously indicated, the illustrated water jacket 36 is defined along its inner periphery by the outer circumferential surface of the cylinder liner 42 and along its outer periphery by the surfaces of the anti-cavitation engine block 22 defining the combustion section 52 of the C5 cylinder. Due to the geometric complexity of the engine block 22, certain surfaces of the anti-cavitation engine block 22 may be recessed (taken in a radially outward direction) relative to the minimum outer diameter of the combustion section 52 ($OD_{C.CS}$). The minimum outer diameter of the combustion section 52 ($OD_{C.CS}$) thus represents a generally cylindrical void or keep-out area into which structural features of the anti-cavitation engine block 22 do not encroach to permit insertion of the cylinder liner 42.

As can be seen in FIG. 4, the thickness of the water jacket 36 is smallest in those areas between the outer diameter of the cylinder liner 42 and the inter-cylinder wall sections 44 of the engine block 22. This is due to cylinder-to-cylinder spacing and other dimensions of the anti-cavitation engine block 22 that may prevent or render impractical enlargement or thickening of the water jacket 36 in these regions without violation of the minimum critical wall thickness of the inter-cylinder wall sections 44(*a*), 44(*b*). In some embodiments, the thickness of the water jacket 36 between the cylinder liner 42 and the inter-cylinder wall sections 44(*a*), 44(*b*) is 3 mm or less—making these areas of the water jacket 36 more susceptible to cavitation.

During operation of the liquid-cooled engine 26 and responsive to piston reciprocation within the cylinder liner 42, radial forces are imposed on the cylinder liner 42. As explained above, in a region of max force displacement 68 of the cylinder liner 42, the radial force imposed by the piston reciprocation, $F_{thrust}$) can cause an affected region of the cylinder liner 42 to bend and bulge outward, for example, as shown in dashed lines in FIG. 5. This outward bending movement of the cylinder liner 42 is translated to the coolant around the liner, thereby causing the coolant particles to move away from the cylinder liner 42 and forming a low-pressure area, i.e., cavitation zone 80, in the water jacket 36 and causing cavitation to occur at this location. Without the anti-cavitation passage 64, the coolant bounces off the inter-cylinder wall section 44(*a*) and pushes all surrounding coolant away from the displaced region of the cylinder liner 42. Upon the cylinder liner 42 bending back to its original position (e.g., after the piston moving past the region 68), a low-pressure zone in the in the water jacket 36 is thus formed at cavitation zone 80 adjacent the outer surface of the cylinder liner 42 that can cause cavitation damage.

The anti-cavitation passage 64 deters cavitation in this targeted region of the water jacket 36 adjacent the region of max force displacement 68 of the cylinder liner 42 by causing coolant to backfill into the cavitation zone 80 adjacent the outer circumferential surface of the cylinder liner 42. That is, the coolant in the water jacket 36 that is forced outwardly and away from the cylinder liner 42 due to the bending or flexing thereof can flow into and through the anti-cavitation passage 64, instead of bouncing off the inter-cylinder wall section 44 and pushing coolant away from the liner thrust displacement. This causes coolant particles near the displaced cylinder liner 42 to backfill into the low-pressure zone in the water jacket 36, adjacent the outer surface of the cylinder liner 42, and thereby prevent formation of a low-pressure zone (cavitation zone 80) and its associated cavitation. In effect, the anti-cavitation passage 64 artificially increases the local thickness of the water jacket 36 in the region of max force displacement 68 of the cylinder liner 42—with the thickness of the water jacket 36 in the area of the anti-cavitation passage 64 effectively equaling the sum of the thickness of the water jacket 36 in cylinder C5, the thickness of the inter-cylinder wall section 44 through which the passage 64 extends, and the thickness of the water jacket 36 in cylinder C4 (that is fluidly connected to the water jacket in cylinder C5 via the anti-cavitation passage 64).

Thus, by forming the anti-cavitation passage 64 in the inter-cylinder wall section 44, local water jacket thickness can be artificially increased adjacent the inter-cylinder wall section 44 without excessive thinning of the wall section 44, thereby resulting in improved circulation of the coolant in the water jacket 36 to prevent cavitation. The provision of the anti-cavitation passage 64 is particularly beneficial when it is impractical or generally undesirable to provide a global increase in water jacket thickness (e.g., by increasing $OD_{C.CS}$) as this would result in, for example, excessive thinning of the inter-cylinder wall sections 44. This, in turn, may reduce the likelihood of cavitation by promoting cooling flow, reducing local pressure drops occurring during engine operation, or otherwise affecting local temperature and pressure conditions in a manner deterring cavitation in these regions of the water jacket 36.

There has thus been provided an example embodiment of an anti-cavitation engine block 22 including anti-cavitation passages 64 formed in selected regions of the inter-cylinder wall sections 44, which improve coolant flow and artificially increase the local radial thickness of the water jackets 36 to reduce the likelihood of water jacket cavitation during operation of a liquid-cooled engine. An example method for manufacturing such an anti-cavitation engine block 22 will now be described.

In a preferred embodiment, the anti-cavitation engine block 22 shown in FIGS. 1-5 is initially cast as a net shape or near net shape. The anti-cavitation passages 64 are created during the initial casting of the engine block preform. Machining may then optionally be performed to further create other refined structural features in the anti-cavitation engine block 22, bring certain dimensions into specification, or otherwise modify the structure of the engine block 22 as desired. In the above-described manner, the anti-cavitation passages 64 are formed in selected regions of the inter-cylinder wall sections 44. The likelihood of cavitation is reduced or eliminated in the targeted regions of the water jackets 36 as a result, to better preserve the structural integrity of the cylinder liners 42 over a prolonged operational lifespan. Further, the anti-cavitation passages 64 may be amenable to integration into existing engine block designs with minor modifications and minimal increases in overall manufacturing cost.

Testing Results and Example Reduction to Practice

Steps were taken to first qualify cavitation damage of cylinder liners tested within a baseline engine block lacking anti-cavitation passages. Testing was performed over a duration of 300 operation hours, after which the cylinder liners were examined. A Likert scale was developed for this purpose, with the Likert scale ranging from a minimum rating of 1 (little to no cavitation damage observed) to a maximum rating of 9 (cavitation has perforated the liner, resulting in engine failure). Likert ratings 2 and above are considered insufficient or undesirable following a 300 hour screening test.

Figure 7:
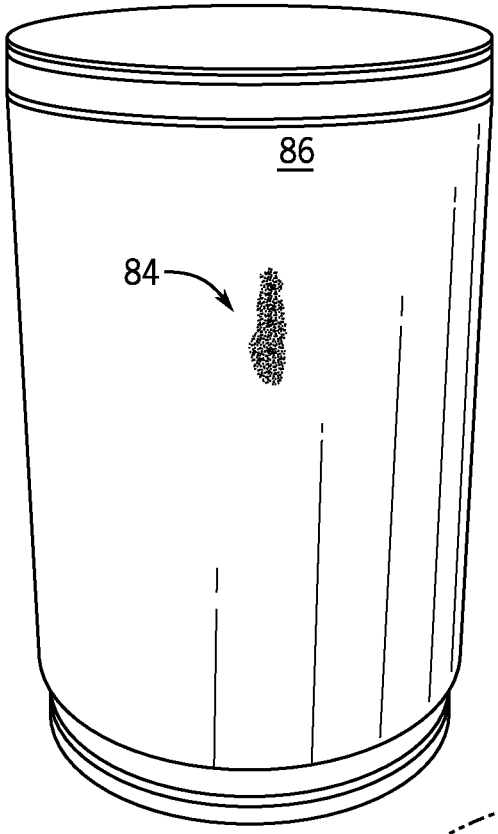
FIG. 7 is a photograph of a cylinder liner exhibiting cavitation damage resulting from being tested in a prior art engine block lacking anti-cavitation passages.

FIG. 7 shows a cylinder liner tested within the baseline engine block lacking anti-cavitation passages according to the specified test, with the depicted cylinder liner being from Cylinder 5 of the engine block. The cavitation-induced damage for the liner is observed in a surface region 84 of the example test cylinder liner 86. The cavitation damage was in the form of frosting located on the rear of the cylinder liner 86 and at a location between 80-100 mm downwardly from the top edge of the cylinder liner 86. Little to no cavitation damage was observed in the other quadrants (the anti-thrust (AT), thrust, or front quadrants) of the cylinder liner 86.

Figure 8:
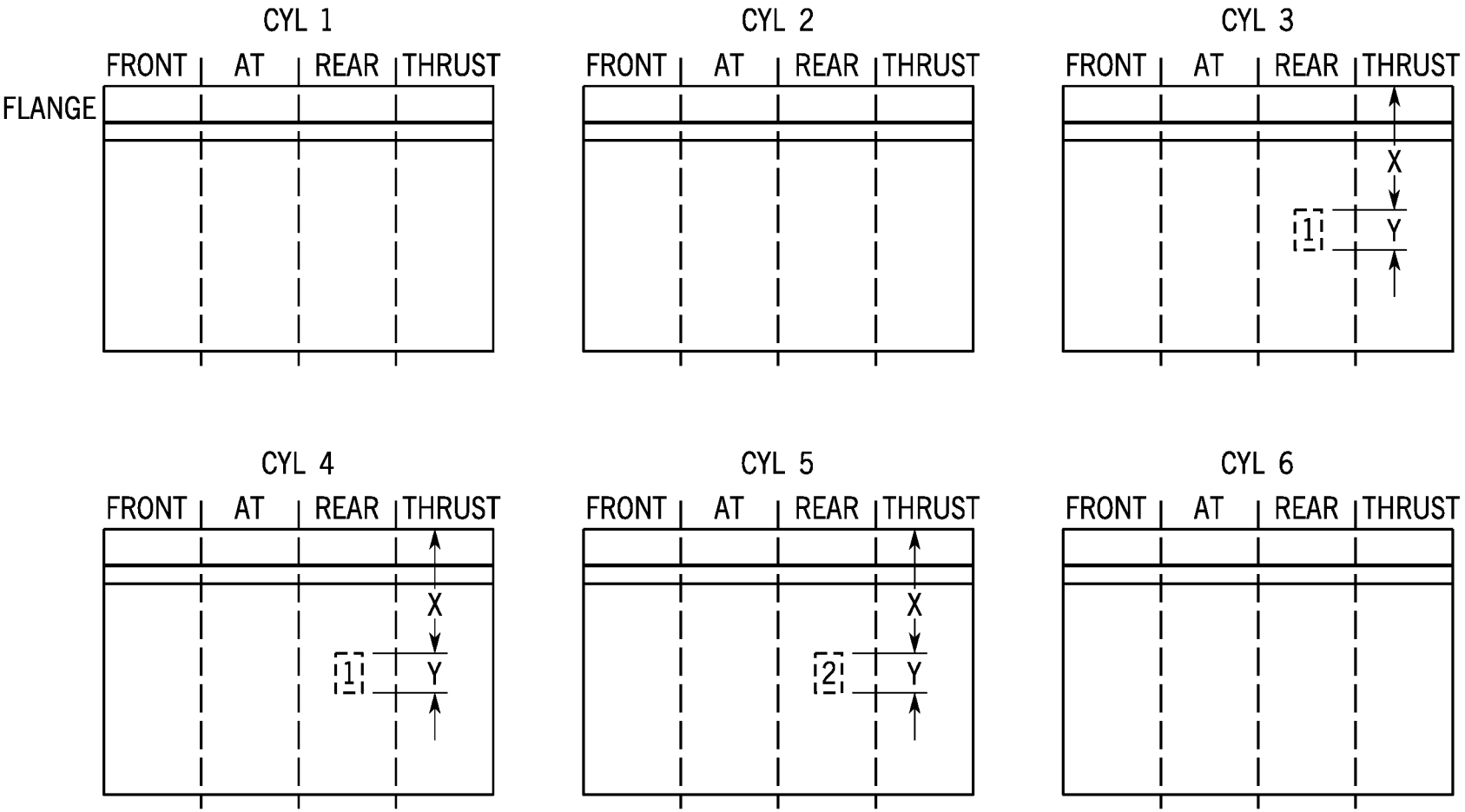
FIG. 8 graphically indicates the location and severity of cavitation damage observed for a cylinder liner tested in a prior art engine block lacking anti-cavitation passages.

The testing results for the cylinder liners in each of the six cylinders in the test engine are presented schematically in FIG. 8. Cavitation damage of Likert scale 2 was observed on the outer diameter of the cylinder liner of Cylinder 5 (as shown in FIG. 7), denoting that frosting (i.e., cylinder liner wear caused by cavitation) was visible to the unaided eye, but pitting had not formed. Cavitation damage of Likert scale 1 was observed on the outer diameter of the cylinder liner of each of Cylinders 3 and 4, denoting that a light frosting was visible upon the application of an additional light source (e.g., a flashlight beam). In each instance, the cavitation damage was located on the rear of the cylinder liner and at a location between 80-100 mm downwardly from the top edge of the cylinder liner, coinciding with a region of maximum thrust displacement of the cylinder liner during testing.

Next, anti-cavitation passages were introduced into the engine block to improve coolant flow adjacent the region of the cylinder liners in which cavitation damage was recorded. The modified engine block was then subjected to a 300 hour screening test, the testing results of which are presented schematically in FIG. 9. In the modified engine block, anti-cavitation passages were created in the inter-cylinder walls at locations corresponding to the observed cavitation damage, as previously described above in connection with FIGS. 2-5, with the anti-cavitation passages structured as illustrated previously in FIG. 6. Accordingly, the passage was formed to have a generally triangular shape, with a height of 46.4 mm, a top angle of 33.1 degrees, and a non-linear base angled out from a bottom center point at 170 degrees. The bottom center point of the passage opening was formed at 95 mm downward from the top edge of the cylinder liner, with the passage opening extending up 46.4 mm therefrom, such that the opening was aligned with the location of the maximum thrust displacement of the cylinder liner at 80 mm downward from the top edge of the cylinder liner.

Figure 9:
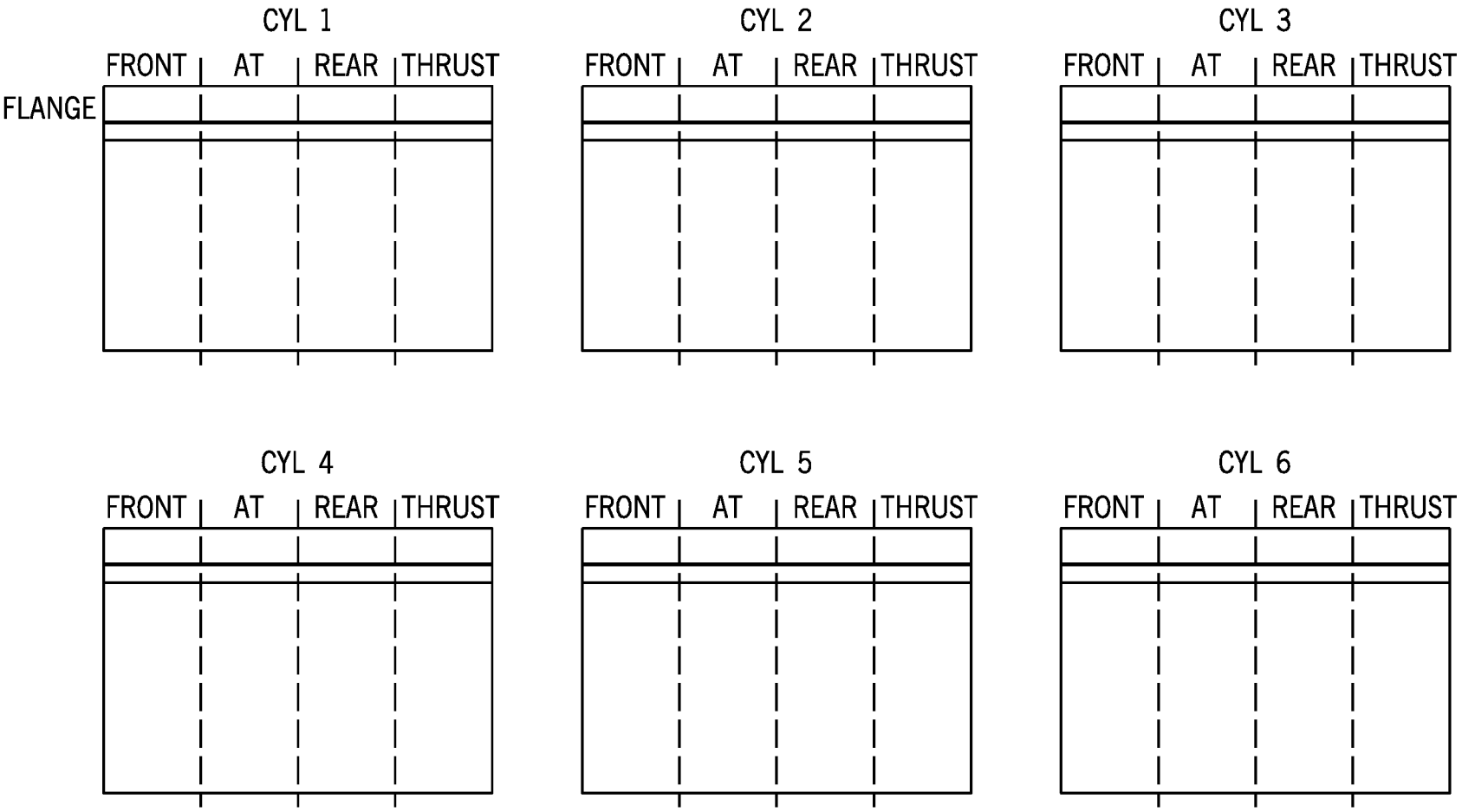
FIG. 9 graphically indicates the location and severity of cavitation damage observed for a cylinder liner tested in an engine block including anti-cavitation passages.

As can be seen in the testing results shown in FIG. 9, the modified engine block demonstrated significantly enhanced protection of the tested cylinder liners from cavitation-induced damage due to a decrease or elimination of cavitation occurring within the surrounding water jackets. That is, no cavitation-caused damage registerable on the Likert rating scale was observed on any of the cylinder liners in the modified engine block.

Enumerated Examples of the Engine Block Assemblies Containing Anti-Cavitation Engine Blocks The following examples of the engine block assemblies including anti-cavitation engine blocks are further provided and numbered for ease of reference.

1. In embodiments, an engine block assembly contains an anti-cavitation engine block. The anti-cavitation engine block includes, in turn, a first cylinder having a first cylinder centerline, a second cylinder having a second cylinder centerline, and an inter-cylinder wall section. The inter-cylinder wall section is located between the first cylinder and the second cylinder, as taken along a longitudinal axis perpendicular to the first and second cylinder centerlines. An anti-cavitation passage is formed through the inter-cylinder wall section that extends between the first cylinder and the second cylinder, while a cylinder liner is inserted into the first cylinder. The cylinder liner has an outer circumferential surface toward which the anti-cavitation passage opens. A water jacket extends at least partially around the outer circumferential surface of the cylinder liner. The anti-cavitation passage is formed through the inter-cylinder wall section at a location adjacent a region of thrust displacement of the cylinder liner, as taken axially along the first cylinder centerline, and enables a flow of liquid coolant in the water jacket therethrough to deter cavitation within the water jacket adjacent the region of thrust displacement of the cylinder liner during operation of the liquid-cooled engine.

2. The engine block assembly of example 1, wherein the anti-cavitation passage is positioned adjacent a location of maximum thrust displacement of the cylinder liner, as taken axially along the first cylinder centerline.

3. The engine block assembly of example 2, wherein the location of maximum thrust displacement is within a range of 25% and 40% of the way down from a top edge of the cylinder liner.

4. The engine block assembly of example 3, wherein the location of maximum thrust displacement is within a range of 70 mm to 90 mm downward from the top edge of the cylinder liner.

5. The engine block assembly of example 2, wherein an opening of the anti-cavitation passage has an area of 140 $mm^2$ or greater.

6. The engine block assembly of example 2, wherein an opening of the anti-cavitation passage extends axially to cover the location of maximum thrust displacement of the cylinder liner.

7. The engine block assembly of example 2, wherein an opening of the anti-cavitation passage has approximately equal areas above and below the location of maximum thrust displacement of the cylinder liner.

8. The engine block assembly of example 2, wherein the anti-cavitation passage causes a backflow of the liquid coolant into a low-pressure zone that is formed adjacent the outer circumferential surface of the cylinder liner at the location of maximum thrust displacement of the cylinder liner during operation of the liquid-cooled engine, responsive to the flow of the liquid coolant into the anti-cavitation passage, thereby deterring cavitation within the water jacket.

9. The engine block assembly of example 1, wherein the anti-cavitation passage is centered about a connecting line extending from the first cylinder centerline to the second cylinder centerline, as taken in a section plane orthogonal to the first cylinder centerline.

10. The engine block assembly of example 1, wherein the anti-cavitation passage includes a generally triangular shaped passage that widens from a top point to a bottom base.

11. The engine block assembly of example 1, wherein the inter-cylinder wall section is a first inter-cylinder wall section and the anti-cavitation passage is a first anti-cavitation passage, and wherein the engine block assembly further includes a third cylinder, a second inter-cylinder wall section located between the first cylinder and the third cylinder, as taken along the longitudinal axis, and a second anti-cavitation passage formed through the second inter-cylinder wall section that extends between the first cylinder and the third cylinder.

12. The engine block assembly of example 11, wherein the second anti-cavitation passage is aligned with the first anti-cavitation passage along the longitudinal axis.

13. The engine block assembly of example 1, wherein a thickness of the water jacket is 3 mm or less in an area between the cylinder liner and the inter-cylinder wall section, and wherein the anti-cavitation passage locally increases the thickness of the water jacket at the location of the anti-cavitation passage.

14. The engine block assembly of example 1, wherein the anti-cavitation engine block comprises a cast engine block body, with the anti-cavitation passage formed in the cast engine block body.

15. In further embodiments, the engine block assembly includes an anti-cavitation engine block utilized within a liquid-cooled engine. A plurality of cylinders is formed in the anti-cavitation engine block having cylinder centerlines and spaced along a longitudinal axis perpendicular to the cylinder centerlines. The anti-cavitation engine block further includes inner block walls bounding outer peripheries of the plurality of cylinders, with the inner block walls including inter-cylinder wall sections interspersed with the plurality of cylinders along the longitudinal axis. Cylinder liners are inserted into the plurality of cylinders, and an anti-cavitation passage is formed through each inter-cylinder wall section, between each adjacent pair of cylinders of the plurality of cylinders, in an upper half of the inter-cylinder wall section.

CONCLUSION

The foregoing has thus provided anti-cavitation engine blocks (and engine block assemblies including anti-cavitation engine blocks) featuring anti-cavitation passages decreasing the likelihood of water jacket cavitation. The anti-cavitation passages are formed in selected regions of the inter-cylinder wall sections partitioning adjacent engine cylinders, e.g., in embodiments, the anti-cavitation passages may be formed in those regions of the inter-cylinder wall sections adjacent surface areas of the cylinder liners identified as suspectable to cavitation damage. In certain embodiments, the anti-cavitation passages may be formed in the inter-cylinder wall sections at locations corresponding to a region of maximum thrust displacement for each cylinder liner. By reducing the likelihood of cavitation in key regions of the water jackets, embodiments of the above-described anti-cavitation engine blocks better preserve the structural integrity of cylinder liners over extended operational lifespans.

As used herein, the singular forms "a", "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Explicitly referenced embodiments herein were chosen and described in order to best explain the principles of the disclosure and their practical application, and to enable others of ordinary skill in the art to understand the disclosure and recognize many alternatives, modifications, and variations on the described example(s). Accordingly, various embodiments and implementations other than those explicitly described are within the scope of the following claims.

What is claimed is:

1. An engine block assembly utilized within a liquid-cooled engine, the engine block assembly comprising:

an anti-cavitation engine block, comprising:

a first cylinder having a first cylinder centerline;

a second cylinder having a second cylinder centerline;

an inter-cylinder wall section located between the first cylinder and the second cylinder, as taken along a longitudinal axis perpendicular to the first cylinder centerline and to the second cylinder centerline; and an anti-cavitation passage formed through the inter-cylinder wall section that extends between the first cylinder and the second cylinder;

a cylinder liner inserted into the first cylinder and having an outer circumferential surface toward which the anti-cavitation passage opens; and a water jacket extending at least partially around the outer circumferential surface of the cylinder liner;

wherein the anti-cavitation passage is formed through the inter-cylinder wall section at a location adjacent a region of thrust displacement of the cylinder liner, as taken axially along the first cylinder centerline, and enables a flow of liquid coolant in the water jacket therethrough to deter cavitation within the water jacket adjacent the region of thrust displacement of the cylinder liner during operation of the liquid-cooled engine.

2. The engine block assembly of claim 1, wherein the anti-cavitation passage is positioned adjacent a location of maximum thrust displacement of the cylinder liner, as taken axially along the first cylinder centerline.

3. The engine block assembly of claim 2, wherein the location of maximum thrust displacement is within a range of 25% and 40% of the way down from a top edge of the cylinder liner.

4. The engine block assembly of claim 3, wherein the location of maximum thrust displacement is within a range of 70 mm to 90 mm downward from the top edge of the cylinder liner.

5. The engine block assembly of claim 2, wherein an opening of the anti-cavitation passage has an area of 140 $mm^2$ or greater.

6. The engine block assembly of claim 2, wherein an opening of the anti-cavitation passage extends axially to cover the location of maximum thrust displacement of the cylinder liner.

7. The engine block assembly of claim 2, wherein an opening of the anti-cavitation passage has approximately equal areas above and below the location of maximum thrust displacement of the cylinder liner.

8. The engine block assembly of claim 2, wherein the anti-cavitation passage causes a backflow of the liquid coolant into a low-pressure zone that is formed adjacent the outer circumferential surface of the cylinder liner at the location of maximum thrust displacement of the cylinder liner during operation of the liquid-cooled engine, responsive to the flow of the liquid coolant into the anti-cavitation passage, thereby deterring cavitation within the water jacket.

9. The engine block assembly of claim 1, wherein the anti-cavitation passage is centered about a connecting line extending from the first cylinder centerline to the second cylinder centerline, as taken in a section plane orthogonal to the first cylinder centerline.

10. The engine block assembly of claim 1, wherein the anti-cavitation passage comprises a generally triangular shaped passage that widens from a top point to a bottom base.

11. The engine block assembly of claim 1, wherein the inter-cylinder wall section comprises a first inter-cylinder wall section and the anti-cavitation passage comprises a first anti-cavitation passage, and wherein the engine block assembly further comprises:

a third cylinder;

a second inter-cylinder wall section located between the first cylinder and the third cylinder, as taken along the longitudinal axis; and a second anti-cavitation passage formed through the second inter-cylinder wall section that extends between the first cylinder and the third cylinder.

12. The engine block assembly of claim 11, wherein the second anti-cavitation passage is aligned with the first anti-cavitation passage along the longitudinal axis.

13. The engine block assembly of claim 1, wherein a thickness of the water jacket is 3 mm or less in an area between the cylinder liner and the inter-cylinder wall section, and wherein the anti-cavitation passage locally increases the thickness of the water jacket at a location of the anti-cavitation passage.

14. The engine block assembly of claim 1, wherein the anti-cavitation engine block comprises a cast engine block body, with the anti-cavitation passage formed in the cast engine block body.

15. An engine block assembly utilized within a liquid-cooled engine, the engine block assembly comprising:

an anti-cavitation engine block, comprising:

a plurality of cylinders having cylinder centerlines and spaced along a longitudinal axis perpendicular to the cylinder centerlines; and inner block walls bounding outer peripheries of the plurality of cylinders, the inner block walls comprising inter-cylinder wall sections interspersed with the plurality of cylinders along the longitudinal axis;

cylinder liners inserted into the plurality of cylinders; and an anti-cavitation passage formed through each inter-cylinder wall section, between each adjacent pair of cylinders of the plurality of cylinders, in an upper half of the inter-cylinder wall section.

16. The engine block assembly of claim 15, wherein each of the cylinder liners has a targeted surface region susceptible to cavitation damage during operation of the liquid-cooled engine, the targeted surface region of each of the cylinder liners comprising a location of maximum thrust displacement of the cylinder liner, as taken axially along the cylinder centerline.

17. The engine block assembly of claim 16, wherein an opening of the anti-cavitation passage has approximately equal areas above and below the location of maximum thrust displacement of the cylinder liner.

18. The engine block assembly of claim 16, wherein an opening of the anti-cavitation passage extends axially to cover the targeted surface region of the cylinder liner susceptible to cavitation damage.

19. The engine block assembly of claim 16, wherein the anti-cavitation passage increases a local thickness of a water jacket adjacent the location of maximum thrust displacement of the cylinder liner to deter cavitation within the water jacket at this location during operation of the liquid-cooled engine, the water jacket defined by an inner peripheral surface of a respective cylinder of the plurality of cylinders and an outer circumferential surface of an associated cylinder liner when inserted into the respective cylinder.

20. The engine block assembly of claim 15, wherein the anti-cavitation passage comprises a generally triangular shaped passage that widens from a top point to a bottom base.

* * * * *